US006294883B1

(12) United States Patent
Weindorf

(10) Patent No.: US 6,294,883 B1
(45) Date of Patent: Sep. 25, 2001

(54) METHOD AND APPARATUS FOR FAST HEATING COLD CATHODE FLUORESCENT LAMPS

(75) Inventor: Paul F. L. Weindorf, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/657,330

(22) Filed: Sep. 7, 2000

(51) Int. Cl.[7] ..... G05F 1/00

(52) U.S. Cl. ..... 315/291; 315/307; 315/149; 315/158; 345/47; 345/212

(58) Field of Search ..... 315/291, 297, 315/307, 224, 225, 209 R, 149, 158, 159; 345/47, 207, 212

(56) References Cited

U.S. PATENT DOCUMENTS 5,663,613 * 9/1997 Yamashita et al. ..... 315/308
5,854,543 * 12/1998 Satoh et al. ..... 315/307
5,907,742 5/1999 Johnson et al. ..... 399/51
5,939,840 8/1999 Nakagawa et al. ..... 315/307
6,184,631 * 2/2001 Noma et al. ..... 315/224

* cited by examiner

*Primary Examiner*—Don Wong
*Assistant Examiner*—Tuyet T. Vo
(74) *Attorney, Agent, or Firm*—Quarles & Brady LLP

(57) ABSTRACT

A method and apparatus are provided for fast heating cold cathode fluorescent lamps (CCFL). Specifically, values corresponding to the actual luminance of a CCFL are compared to a desired luminance level and, if it is determined that the CCFL is operating under start-up conditions, a boost power supply is applied to the CCFL until either the CCFL outputs the desired luminance level, or a timer determines that start-up conditions no longer exist.

24 Claims, 2 Drawing Sheets

FIG. 1
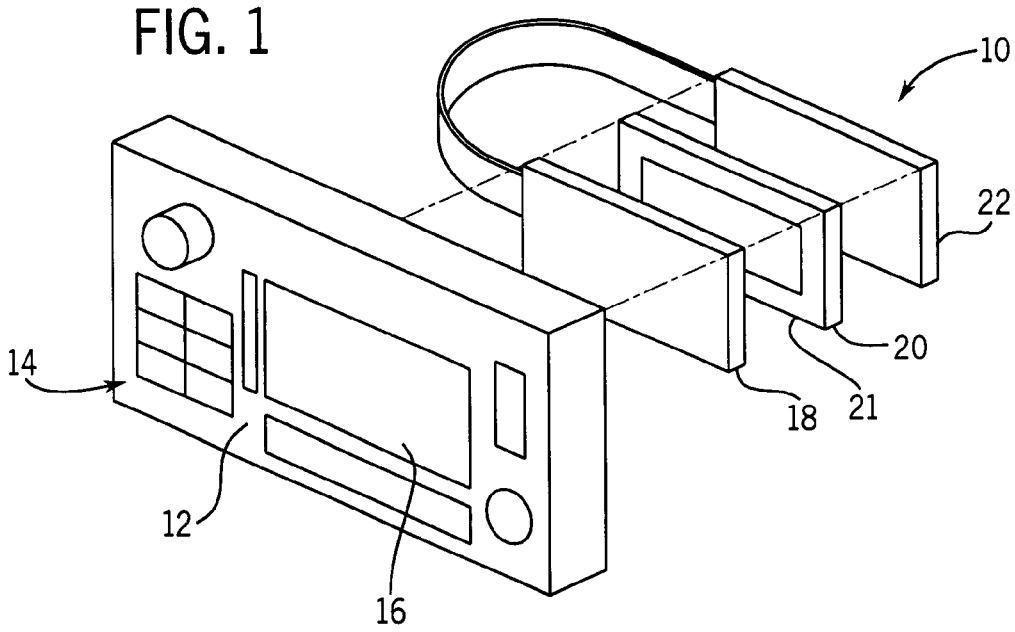
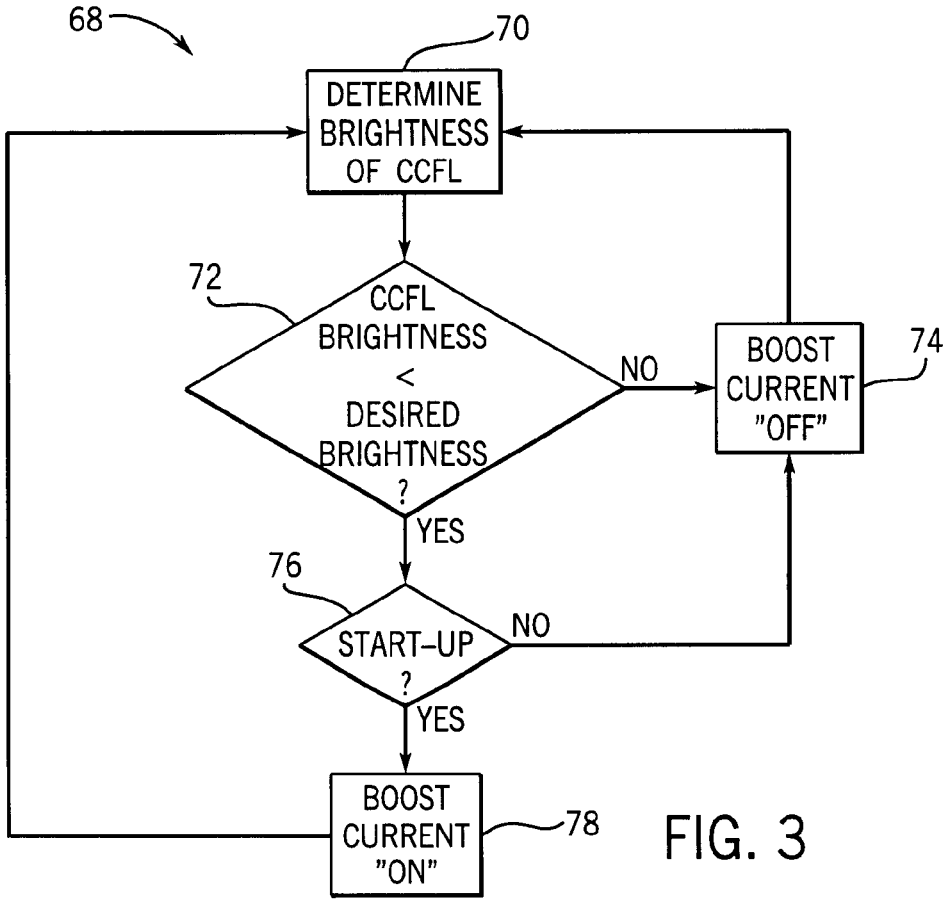
FIG. 3

METHOD AND APPARATUS FOR FAST HEATING COLD CATHODE FLUORESCENT LAMPS

BACKGROUND OF THE INVENTION

1. Field of the Invention

The present invention relates generally to controllers for lamps used to illuminate liquid crystal displays ("backlights") and the like and, in particular, to a method and apparatus for fast heating a cold cathode fluorescent lamp.

2. Description of the Related Art

Liquid crystal displays (LCD) provide a rugged and flexible display suitable for use in automotive applications. The LCD is backlit typically by a cold cathode fluorescent lamp (CCFL). Such fluorescent lamps are bright and relatively efficient and can be fabricated to provide even illumination over a large area. CCFL's are particularly useful to provide backlighting for illuminated vehicular displays.

Unfortunately, CCFL's are sensitive to temperature and vary in luminance as the passenger compartment and console warms up. During cold start conditions, for example, the initial luminance level of the CCFL may be unacceptably low to an operator of the vehicle. One method for compensating for this low luminance is to use a high-pressure self-heating type CCFL and to supply a "boost current" to the CCFL during startup. The boost current is an additional amount of lamp current above the normal maximum levels, resulting in an increased power supply, which is converted by the CCFL into heat to raise the lamp temperature, thereby facilitating increased lamp efficiency and a corresponding increased lamp luminance.

However, supplying a boost current increases the rate at which the mercury (Hg) inside the lamp is expended, causing premature failure resulting in extreme and sudden loss in luminance of the CCFL. For example, the life reduction of the CCFL operating at an ambient temperature greater than 30° C. can be defined by the equation $$L_B = \left(\frac{I_N}{I_B}\right)^{1.5} * L_N \tag{1}$$

where $L_B$ is the life span of the CCFL using boost current, $I_B$; and $L_N$ is the normal CCFL life span under normal or recommended operating current, $I_N$. The life of the CCFL under boost current is significantly reduced further when the ambient temperature is below 30° C., as would be experienced during cold startup conditions. For example, it has been determined that the life span of the CCFL may be reduced by over 150 hours per start when the boost current is unnecessarily applied upon startup of the CCFL.

Accordingly, what is needed is a method and apparatus for supplying a boost current to a CCFL only when necessary during cold startup conditions.

BRIEF SUMMARY OF THE INVENTION

In accordance with a first aspect of the invention, the luminance output of a backlight is dynamically controlled by supplying power to the backlight, and determining whether the actual luminance level of the backlight is less than a commanded luminance level, at which point a boost current is automatically supplied to the backlight to increase the actual output.

These as well as other features and characteristics of the present invention will be apparent from the description which follows. In the detailed description below, preferred embodiments of the invention will be described with reference to the accompanying drawings. These embodiments do not represent the full scope of the invention. Rather the invention may be employed in other embodiments. Reference should therefore be made to the claims herein for interpreting the breadth of the invention.

BRIEF DESCRIPTION OF THE DRAWINGS

Reference is hereby made to the following figures in which like reference numerals correspond to like elements, and in which:

FIG. 1 is a perspective, exploded view of an automotive control console;

FIG. 3 is a flow chart generally illustrating a method used to carry out the preferred embodiment.

DETAILED DESCRIPTION OF THE INVENTION

Figure 2:
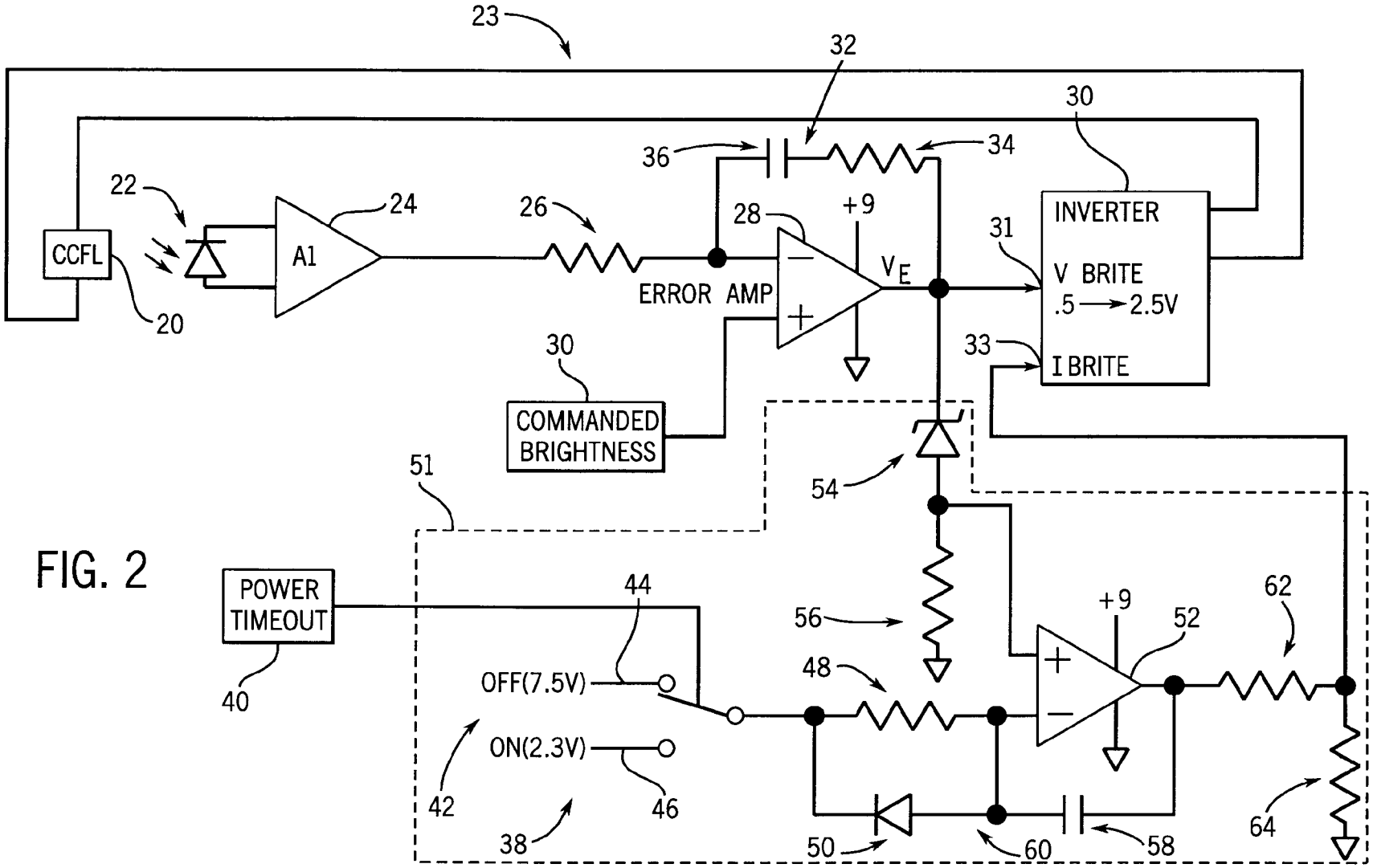
FIG. 2 is a simplified block diagram of the control circuitry in accordance with the preferred embodiment.

Referring to FIG. 1, an automotive console 10 includes a bezel 12 supporting user controls 14 and a display opening 16. Position behind the display opening 16 is a liquid crystal display ("LCD") 18 followed by a fluorescent backlight 20. The fluorescent backlight 20 surrounds a light pipe 21 to provide a large area, even illumination commensurate with the area of the LCD 18. The backlight provides light passing through the LCD 18 so as to make figures displayed on the LCD 18 visible through the opening 16 to a driver or passenger for all lighting conditions ranging from full sunlight to conditions of low ambient light.

A circuit card 22 may be positioned behind the backlight 20 to support control electronics in accordance with the preferred embodiment as well as the necessary control electronics for the LCD 18.

Referring now to FIG. 2, feedback circuitry 23 includes a light sensor, preferably a photodiode 22 that detects a level of luminance emitted by the CCFL 20, and supplies current having a feedback voltage level to an amplifier 24. The feedback voltage, corresponding to the CCFL luminance, then travels through a resistor 26 and into the negative terminal of an error amplifier 28 which operates as an integrator as will be described. A voltage level corresponding to a commanded luminance signal 30 is input into the positive terminal of the error amplifier 28. The error amp 28 outputs an output voltage $V_E$ to terminal 31 of an inverter 30, and further includes a feedback loop 32 having a resistor 34 connected in series with a capacitor 36 that are, in turn, connected in parallel with the error amplifier 28. Under normal steady state operating conditions, the sensed luminance from the CCFL 20 will be equal to the commanded luminance, and the error amplifier 28 will maintain the output voltage $V_E$ in accordance with the steady state. Typically, the error amplifier output $V_E$ is operating somewhere within the inverter 30 input dynamic range of 0.5 to 2.5 volts in accordance with the preferred embodiment. The Inverter dynamic range of 0.5V to 2.5V at terminal 31 corresponds to Inverter Pulse Width Time Modulation of 0% to 100% of the CCFL current level commanded at terminal 33.

At cold temperatures, however, the CCFL efficiency is severely decreased from room temperature operation by as much as 25:1. Under these circumstances, the feedback luminance even in steady state will likely be less than the commanded luminance because of limits of CCFL output, and the error amplifier 28 will transition to the positive rail voltage of approximately 9 volts. Accordingly, the output voltage $V_E$ may be examined to determine whether the CCFL 20 is achieving the steady state commanded luminance. If not, a boost current will be supplied to the inverter to supply heat to the CCFL 20, thereby increasing its efficiency and resulting in accelerated increased luminance, as will be described below.

With continuing reference to FIG. 2, a boost current circuit 38 includes a "power on, time out" element that 40 controls a boost circuit switch 42 having a "off" position 44, and a "on" position 46. Upon start-up of the CCFL 20, the circuit 40 will activate the boost switch 42 to the on position 46 for a predetermined length of time as defined by the time-out element 40, at which point the switch 42 will revert to the off position 44. As will be described below, even though the boost switch 42 is in the "on" position 46, boost current may or may not be supplied to the CCFL, according to the voltage level $V_E$ that is output by the feedback circuit 23. The output from the boost switch 42 feeds into a resistor 48 that is connected in parallel with a diode 50.

A boost current amplifier 52, also an integrator in accordance with the preferred embodiment, includes a negative terminal that is connected in series with the resistor 48, and receives voltage output from the boost switch 42, and a positive terminal that receives voltage output from the error amplifier 28 via a diode 54. The output from diode 54 is further grounded at ground 56, as is well known in the art. A capacitor 58, connected in series with diode 50, is further connected in parallel with the boost current amplifier 52, thereby providing a feedback loop 60. A resistor 62 is further connected in series with the boost current amplifier 52 at a location downstream of the feedback loop 60. Voltage dividers 62 and 64 are selected such that when amplifier 52 is at its positive rail, the boost current signal at terminal 33 is at the CCFL boost current maximum.

The operation of the preferred embodiment will now be described with reference to the above-described circuitry. Operation commences upon start-up of the CCFL 20, which operates at a given luminance level that is detected by the photodiode 22. The output voltage from photodiode 22 is input to the amplifier 24, travels through the resistor 26, and into the negative terminal of the error amplifier 28. A predetermined commanded luminance level is fed into the positive terminal of the error amplifier 28 and the corresponding output voltage $V_E$ is dependent upon the integral of the difference between voltage values being input into the negative and positive terminals. For instance, if the voltage levels corresponding to the sensed luminance of the CCFL 20 is less than the voltage corresponding to the commanded luminance, the error amplifier 28 will ramp up so as to produce an output voltage $V_E$ having a maximum value of nine volts. Once the voltages being input to the positive and negative terminals of the error amplifier 28 are equal, thereby indicating a steady state condition, the feedback loop 32 will maintain the output voltage $V_E$ at the necessary level to maintain the steady state condition. When the lamp is producing the desired luminance, $V_E$ will fall within a range of 0.5 to 2.5 volts in accordance with the preferred embodiment. When $V_E$ is not within this range, it is likely that the CCFL 20 is cold and unable to produce the desired light output.

The output voltage $V_E$ is additionally input into the diode 54 having a voltage of 5.1 volts. Accordingly, the input into the positive terminal of the boost current amplifier 52 is the difference between $V_E$ and 5.1 volts ($V_E$-5.1). Therefore, when the boost switch 42 is off at 44, 7.5 volts will be input into the negative terminal of the boost current amplifier 52. Accordingly, under these circumstances, the amplifier 52 will output a zero voltage. This is because the positive terminal of amplifier 52 will necessarily be less than 7.5 volts, given that the maximum value of $V_E$ is 9 volts, and that $V_E$ is dropped by 5.1 volts at diode 54, thereby resulting in a maximum input of 3.9 volts into the positive terminal of amplifier 52. Accordingly, when the switch 42 is in the off position 44, no voltage will be input into terminal 33 of the inverter 30, and no boost current will therefore be supplied to the CCFL 20.

If, on the other hand, the switch 42 is in the "on" position 46, 2.3 volts will be input into the negative terminal of the boost current amplifier 52. Accordingly, the amplifier 52 will output a boost current to the inverter 30 and correspondingly to the CCFL 20 when the input the positive terminal of the amplifier 52 is greater than 2.3 volts. Therefore, boost current will be supplied when switch 42 is on, and $V_E$ is greater than 7.4 volts (2.3+5.1), which will occur when the detected luminance level of the CCFL is less than the commanded luminance, and $V_E$ has had time to ramp to more than 7.4 volts, indicating that a steady state condition has not yet been achieved. Accordingly, boost current will only supplied to the CCFL 20 when the luminance output from the CCFL 20 is sufficiently low so as to allow time for $V_E$ to ramp to a level greater than 7.4 volts.

Therefore, even if the boost switch 42 is in the on position 46, no boost current will be supplied to the CCFL 20 if the CCFL luminance is equal to the commanded luminance. Additionally, even when the CCFL luminance is less than the commanded luminance, once $V_E$ begins ramping down, thereby indicating that the CCFL luminance is approaching the commanded luminance, no boost current will be sent to the CCFL 20 when 1) $V_E$ has ramped down to less than 7.4 volts, or 2) $V_E$ has ramped up to a value less than 7.4 volts, signifying that the CCFL is operating at a level lower than, but not sufficiently lower than, the commanded luminance. Additionally, as $V_E$ approaches and surpasses 7.4V, such that $V^+$ is infinitesimally greater than $V^{31}$ on boost current amplifier 52, a boost current level will be desired that is less than the maximum boost to maintain the commanded brightness. Accordingly, if less boost is required, the output from amplifier 52 ramps to a voltage that controls terminal 33 to a boost level required to maintain the commanded brightness. Accordingly, only the necessary magnitude of boost current is applied to maintain the commanded brightness, thereby extending the life of the CCFL 20.

Furthermore, it should be understood that boost conditions may exist when $V_E$ is at 7.4V such that $V^+$ and $V^-$ are equal at 2.3V in accordance with the preferred embodiment. This will occur when a boost current level between a no boost condition and a full boost condition is necessary. Therefore, if less boost current is required than the maximum in order to maintain the commanded brightness, $V_E$ goes to 7.4V and the output from amplifier 52 goes to a voltage which controls terminal 33 to a boost level to maintain the commanded brightness. Accordingly, only the necessary magnitude of boost current is commanded to obtain the commanded luminance, thereby extending the CCFL life.

In accordance with the preferred embodiment, the boost current transitions from a "on" state to a "off" state at a relatively slow rate of change so as to prevent drastic changes or flickering of the luminance of the CCFL 20. As mentioned above, the boost current will be turned off in one of two situations. The first situation occurs when the timeout circuit sets the boost switch 42 to the off position 44, thereby generating 7.5 volts to the negative terminal of the boost current amplifier 52. It should be apparent that the time-out function will permit boost current to be supplied for a limited duration in case certain elements within the circuitry are not working properly, thereby maximizing the life of the CCFL 20. Under a time-out condition, the rate of voltage change output from the boost current amplifier 52 is determined by the following equation:

$$\frac{\Delta V}{\Delta T} = \frac{(V_E - 5.1) = 7.5\text{ V}}{(R_{48})(C_{58})} \quad (2)$$

where ΔV is the change in voltage levels across the positive and negative terminals of the boost current amplifier 52; ΔT is the time necessary to transition from a boost current "on" to the "off" state; $R_{48}$ is the resistance of the resistor 48 in accordance with the preferred embodiment; and $C_{58}$ is the capacitance of the capacitor 58 in accordance with the preferred embodiment.

Substituting the appropriate values for the variables in Equation (1) using the situation where the error amplifier 28 is at the positive rail ($V_E$=9 volts), $$\frac{3.9 - 7.5\text{ V}}{(2.1\text{ M}\Omega)(1\ \mu\text{F})} = -1.71\text{ V/second} \quad (3)$$

Because the error amplifier 28 is at the positive rail for this calculation, the voltage level of the boost current will decrease at a maximum rate of 1.71 volts per second when transitioning from the "on" state to the "off" state.

The second condition whereby the boost current will transition from "on" to "off"is when 1) the boost switch 42 is in the "on" position 46, thereby supplying 2.3 volts to the negative terminal of the boost current amplifier 52, and 2) $V_E$ begins to decrease, such as is the first case when the luminance of CCFL 20 begins to approach the commanded luminance. Because, in this situation, $V_E$ will have a value less than 7.4 volts, a magnitude of less than 2.3 volts will be input into the positive terminal of the boost current amplifier 52. Accordingly, when $V_E$ is less than 5.1V, the rate of voltage change is determined by $$\frac{0 - 2.3\text{ V}}{2.1\text{ M}\Omega * 1\ \mu\text{F}} = -1.1\text{ V/second} \quad (4)$$

The gradual rate of voltage change of the boost current is also desirable during a transitory condition, whereby $V_E$ is ramping down at a value less than 7.4 volts but greater than the steady state condition of 0.5 to 2.5 volts. During this condition, the boost current will be decreasing while $V_E$ is ramping down to the steady state.

It should be appreciated by one having ordinary skill in the art that the chosen voltage, resistance, capacitance, and voltage drop values for the various elements of the circuit illustrated in FIG. 2 may be varied without departing from the scope and the spirit of the present invention. It should further be appreciated that other suitable indicators corresponding to the luminance levels of the CCFL 20 may be relied upon as an alternative to luminance. For instance, a thermal detector on the CCFL can be used in conjunction with a look up table to control terminal 31 for the commanded brightness, as would be appreciated by one having ordinary skill in the art. Therefore, the present invention could use terminal 31 to control the boost current. Accordingly, the present invention is not intended to be limited to the detection of luminance signals from the CCFL 20.

Additionally, it should be further appreciated that while hardware elements are shown, in the circuitry in accordance with the preferred embodiment, it should be apparent to one having ordinary skill in the art that the functions performed by the hardware elements, such as integrators 28 and 52, could also be performed by appropriately programmed microprocessors or other alternative software apparatus. Accordingly, in another embodiment, the combination of the boost current circuit 38 and feedback loop 60 are illustrated as being part of a software, or microprocessor, based system 51 shown in broken lines in FIG. 2. Specifically, the analog $V_E$ is fed through an analog-to-digital converter (not shown) and input into the microprocessor along with digital inputs from the timer 40. The microprocessor then outputs a digital boost current signal if necessary, as described above, which is then fed through a digital-to-analog-converter (not shown) and input into terminal 33. It should be appreciated that the microprocessor could be modified to perform the function of the timer 40.

With reference now to FIG. 3, a method for controlling boost current 68 begins at process block 70 where the luminance level of the CCFL 20 is determined using photodiode 22 or other suitable apparatus. Next, at decision block 72, it is determined whether the CCFL luminance is less than the desired luminance, such as would be the condition during a cold-startup situation. If the CCFL luminance is greater than or equal to the desired luminance, process 68 will proceed to step 74, whereby the boost current is transitional to the "off" condition, before reverting the CCFL luminance determination step 70. If, however, it is determined at decision block 72 that the CCFL luminance is less than the desired luminance, process 68 will continue to step 76, whereby it will be determined whether a startup condition exists, as would be indicated by a "on" position of the timeout circuit 40. If a startup condition exists, the boost current is turned on at process 78 before once again determining the luminance of the CCFL 20 at step 70. If, on the other hand, a startup condition does not exist, process 68 will once again revert to step 74 to ensure that the boost current is in a "off" condition.

The invention has been described in connection with what are presently considered to be the most practical and preferred embodiments. However, the present invention has been presented by way of illustration and is not intended to be limited to the disclosed embodiments. Accordingly, those skilled in the art will realize that the invention is intended to encompass all modifications and alternative arrangements included within the spirit and scope of the invention, as set forth by the appended claims.

I claim:

1. A system for controlling luminance output from a backlight usable in combination with an illuminated vehicular display, the system comprising:

a sensor configured to receive actual signals indicating an actual luminance level of said backlight;

a first integrator configured to compare said actual luminance signals to predetermined desired signals and output the integration of the difference thereof; and a second integrator configured to receive said output of said first integrator and supply a boost power level to said backlight when 1) it is determined that said backlight is in a start-up period and 2) said actual luminance level has been less than said desired luminance level for a predetermined amount of time.

2. The system as recited in claim 1, wherein said first integrator outputs an integrated voltage level that is received by said second integrator, and wherein said power command signal is a second voltage level, and wherein said second integrator compares said integrated voltage level to said second voltage level and outputs said boost power level when integrated voltage level is greater than said third voltage level.

3. The system as recited in claim 1, further comprising a heat sensor configured to output said desired signals.

4. The system as recited in claim 3, further comprising a voltage drop disposed between said first and second integrators, wherein said voltage drop decreases said integrated voltage level by a predetermined amount.

5. A method for dynamically controlling luminance output from a backlight of a vehicular display comprising, said backlight providing illumination to said display, the method comprising:

(A) inputting a first power level to said backlight from a first power source, wherein said first power level varies over a range including a predetermined control range;

(B) sensing a first signal corresponding to an actual luminance level of said backlight;

(C) comparing said first signal to a second signal corresponding to a desired luminance level of said backlight;

(D) adjusting said first power level when said actual luminance level is not equal to said desired luminance level; and (E) automatically inputting a boost power level to said backlight when said first power level exceeds said control range.

6. The method as recited in claim 5, further comprising inputting said boost power level only when said actual display luminance is a predetermined amount less than said desired display luminance.

7. The method as recited in claim 5, wherein said backlight is a cold cathode fluorescent lamp.

8. The method as recited in claim 5, wherein said boost power level is input only when it is determined that a start-up condition exists.

9. The method as recited in claim 5, wherein step (B) further comprises sensing luminance levels of said backlight.

10. The method as recited in claim 5, wherein step (B) further comprises sensing thermal levels of said backlight in conjunction with a look up table to determine said actual brightness level.

11. The method as recited in claim 5, wherein step (E) further comprises inputting said boost power level at a constant level less than a maximum boost power level.

12. The method as recited in claim 5, wherein step (B) further comprises sensing a voltage level indicating whether said actual luminance is less than said desired luminance.

13. The method as recited in claim 12, wherein said boost power level is input to said backlight when said sensed voltage level is greater than a predetermined threshold.

14. The method as recited in claim 13, comprising reducing said boost power level at a predetermined rate when said sensed voltage transitions from a level greater than said predetermined threshold to a level less than said predetermined threshold.

15. The method as recited in claim 5, wherein step (E) further comprises inputting said boost power level when said first power level is at a predetermined power level greater than a maximum level of said control range.

16. The method as recited in claim 15, further comprising reducing said boost power level when first power level transitions from a level greater than said predetermined power level to a level less than said predetermined power level.

17. The method as recited in claim 16, further comprising removing said boost power level from said backlight when said first power level is within said predetermined control range.

18. The method as recited in claim 15, further comprising gradually reducing said boost power level from said backlight upon expiration of a timer.

19. The method as recited in claim 18, further comprising removing said boost power level a predetermined time after expiration of said timer.

20. A method for controlling the luminance of a backlight configured for operation in combination with an illuminated vehicular display, the method comprising:

(A) supplying a first power level to said backlight, wherein said backlight is configured to output an actual luminance level;

(B) sensing a signal corresponding to said actual brightness level;

(C) based on said signal, determining whether said actual luminance level is equal to a predetermined desired luminance level; and (D) adjusting said power when it is determined that said actual luminance level is not equal to said desired luminance level for a predetermined amount of time.

21. The method as recited in claim 20, wherein step (D) further comprises supplying a boost power level to said backlight when it is determined that said actual luminance level is less than said desired luminance level.

22. The system as recited in claim 21, further comprising a luminance sensor configured to output said desired signals.

23. The system as recited in claim 21, further comprising a boost power switch configured to output a power command signal to said second integrator indicating whether said backlight is in a start-up period.

24. The system as recited in claim 23, further comprising a timer that controls said switch to output said power command signals indicating a start-up condition only for a second predetermined amount of time.

* * * * *

UNITED STATES PATENT AND TRADEMARK OFFICE

CERTIFICATE OF CORRECTION

PATENT NO. : 6,294,883 B1 
DATED : September 25, 2001
INVENTOR(S) : Weindorf

It is certified that error appears in the above-identified patent and that said Letters Patent is hereby corrected as shown below:

Column 4,
Line 39, "$V^{31}$" should be -- $V^{-}$ --

Column 5,
Line 10, equation, "=7.5V" should be -- -7.5V --

Signed and Sealed this

Fourth Day of June, 2002

*Attest:*

*Attesting Officer*

JAMES E. ROGAN
*Director of the United States Patent and Trademark Office*